United States Patent [19]

Wood et al.

[11] Patent Number: 4,670,625

[45] Date of Patent: Jun. 2, 1987

[54] ELECTRICAL INSULATING BUSHING WITH A WEATHER-RESISTANT SHEATH

[76] Inventors: Henry S. Wood, The Old Bakehouse, Main Street, Turweston, Nr. Brackley, NN13 5JU; John L. Davenport, 28 Strines Road, Marple, Stockport, both of England

[21] Appl. No.: 886,193

[22] Filed: Jul. 16, 1986

Related U.S. Application Data

[63] Continuation of Ser. No. 633,970, Jul. 24, 1986, abandoned.

[51] Int. Cl.[4] ..... H01B 17/26; H01B 17/42; H01B 17/50

[52] U.S. Cl. ..... 174/142; 174/73 R; 174/152 R; 174/DIG. 10

[58] Field of Search ..... 174/73 R, 73 SC, 80, 174/142, 143, 152 R, 179, 209, DIG. 10

[56] References Cited

U.S. PATENT DOCUMENTS

| | | | |
|---|---|---|---|
| 2,459,612 | 1/1949 | Baker | 174/DIG. 10 X |
| 3,515,799 | 6/1970 | Ristuccia et al. | 174/143 X |
| 3,531,580 | 9/1970 | Foster | 174/152 R |
| 3,604,830 | 9/1971 | Frakes | 174/152 R X |
| 3,898,372 | 8/1975 | Kalb | 174/137 B X |
| 4,312,123 | 1/1982 | Wheeler | 174/152 R X |

FOREIGN PATENT DOCUMENTS

| | | | |
|---|---|---|---|
| 56-19812 | 2/1981 | Japan | 174/152 R |

OTHER PUBLICATIONS

General Electric Co. brochure, "Termi-Matic Cable Termination Systems", published by General Electric Insulating Materials Department, Schenectady, N.Y., Oct. 1969, 8 pages total.

*Primary Examiner*—Laramie E. Askim
*Attorney, Agent, or Firm*—Kirschstein, Kirschstein, Ottinger & Israel

[57] ABSTRACT

A bushing arrangement for conveying an electrical conductor through the casing of high voltage electrical apparatus exposed to the weather comprises a rigid member of synthetic resin cast around, so as to be bonded in a gas tight manner to, the conductor, and incorporating an exterior portion protruding outside the casing, the member being enclosed, over at least the major part of its exterior portion, by a plurality of insulting axially-overlapping weather-resistant collars and a stress cone each having a creepage flange or shed, the member being secured to the casing by a flanged collar. The insulating member may be made of a relatively cheap non-weather-resistant epoxy resin and the collars of EPDM rubber.

10 Claims, 1 Drawing Figure

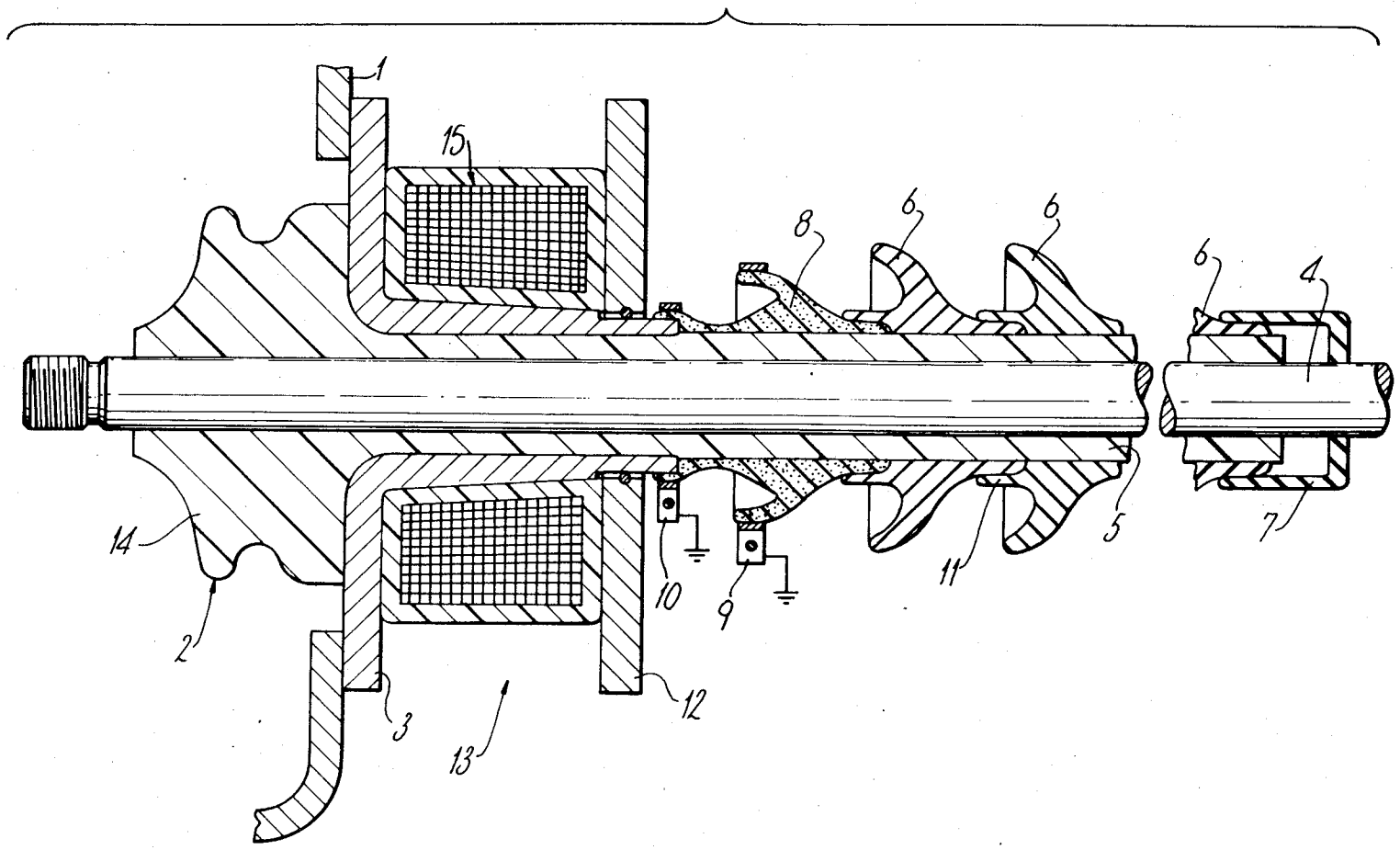
4
7
6
5
6
11
6
8
9
10
12
15
13
1
3
2
14

ELECTRICAL INSULATING BUSHING WITH A WEATHER-RESISTANT SHEATH

CROSS-REFERENCE TO RELATED APPLICATION

This invention is a continuation of U.S. patent application Ser. No. 633,970 filed July 24, 1984, now abandoned.

FIELD OF THE INVENTION

The present invention relates to electrically insulating bushings and the like suitable for conveying electrical conductors through the casing of electrical equipment to the outside atmosphere. The invention is especially applicable to high power, high voltage electrical equipment such as power transformers and switchgear which is situated in the open air and incorporates one or more metallic conductors which extend outwards through a metallic casing.

A major problem associated with the design of bushings for such equipment arises from the high rated voltages involved, which may range from 12 to 36 kV. As a result, very intense electric fields are produced between the conductors and the casing, so that the conductor-bushings must have an extremely high dielectric strength.

PRIOR ART

Hitherto, the only suitable plastic material which has also possessed the necessary weather-resistance has been cyclo-aliphatic resin. Because this material is relatively expensive and cannot easily be moulded into the required shape, it has not proved economical to use this material for the large bushings which are required to withstand voltages of 15 kV or more. Consequently, hollow, oil-filled porcelain bushings have been generally used on high voltage equipment. Usually a cast metal bushing cap incorporating a sight glass for oil-level indication has been found necessary on bushings of this type. Porcelain bushings are therefore complicated and expensive, and, being relatively fragile, are susceptible to mechanical damage. Although it has been proposed to form some bushings from synthetic resin, such bushings have not hitherto been found suitable for conveying conductors through the casings of high electrical equipment.

OBJECT OF THE INVENTION

An object of the present invention is to provide a simple relatively inexpensive weather-resistant bushing for supporting an electrical conductor passing through the casing of electrical equipment which is able to withstand high voltages.

SUMMARY OF THE INVENTION

According to the present invention, an insulating bushing which passes through, and is stationarily supported by, a casing wall of a high voltage electrical apparatus exposed to the weather, comprises:

(a) an elongated, rigid electrical conductor extending in an axial direction through a casing wall of a high voltage electrical apparatus;

(b) a rigid tubular insulating member of synthetic resin cast around so as to be bonded in a gas tight manner to the electrical conductor and having an interior end portion adapted to be located within the casing wall of the apparatus, and an elongated exterior portion unitary with, and extending axially from, the interior portion beyond the casing wall of the apparatus, said exterior portion having an end face;

(c) a sheath of weather-resistant insulating material mounted on and enclosing the exterior portion over a major portion of the length of the exterior portion, said sheath including a plurality of axially overlapping and interfitted, individually distinct collars which together extend over the major portion of the length of the exterior portion, said collars being readily detachable from the exterior portion, said sheath further including an insulating cap covering the end face of the exterior portion and detachably mounted on the one of the collars nearest the end face; and (d) further comprising a rigid support member having a flange portion in supported engagement with the casing wall, and an axially-extending collar portion surrounding and supportably engaging the exterior portion over a minor portion of the length of the exterior portion.

Preferably the insulating cap is of resilient flexible material.

The collars preferably have dished flanges or sheds in order to increase the creepage and flashover lengths and to prevent tracking. The joints between the collars may be sealed with weather-resistant grease.

The tubular member is conveniently made from epoxy resin or polyurethane resin. Such materials have excellent insulating properties but generally deteriorate on exposure to the weather. Thus, a bushing in accordance with the invention suitable for use at 36 kV can be manufactured at a considerably lower cost than an equivalent cyclo-aliphatic-resin bushing.

Preferably the exterior portion of the tubular member is in the form of a plain cylinder, so that bushings suitable for various working voltages may be produced simply by varying the length of the exterior portion and covering it with the appropriate number of insulating collars.

We have found that EPDM rubber, which is a terpolymer of ethylene, proplene, and a non-conjugated diene, is a suitable material for the construction of the insulating collars and end caps.

A current transformer may conveniently be supported by the combined flange and collar.

BRIEF DESCRIPTION OF THE DRAWING

One example of a bushing in accordance with the invention will now be described with reference to the accompanying drawing wherein the single FIGURE shows a longitudinal sectional view of the bushing arrangement.

DETAILED DESCRIPTION OF THE PREFERRED EMBODIMENT

The drawing is a sectional view of a bushing fixed to the casing 1 of a high voltage electrical apparatus (not shown), which may be a transformer or a circuit breaker, for example. All the parts are generally circular in radial cross section. The bushing comprises a generally tubular insulating member 2 made of epoxy or polyurethane resin cast around, so as to be bonded to, a conducting stud 4. At the inner end the insulating member 2 is surrounded by a support member 3 in the form of a combined flange and collar made of cast aluminium.

The support member 3 is shrunk onto and bonded to the tubular member 2, and therefore forms a gas tight seal, the flange being supported by the casing wall. The conducting stud 4 extends from the interior to the exterior of the apparatus through the tubular member 2 and forms a gas tight seal with the latter. The exterior portion 5 of the tubular member 2 is enclosed within a weather-resistant sheath comprising a plurality of axially overlapping dished collars 6 made of EPDM rubber.

It will be appreciated that the length of the exterior portion 5 and the corresponding number of collars with dished flanges or sheds may be appropriately chosen to suit the potential of the conducting stud 4. For example, the exterior portion may be approximately 500 mm long and 90 mm in diameter, when the rated voltage is 36 kV, and is suitably covered by approximately ten insulating collars.

The outer end of the bushing shown is covered by an insulating cap 7 of EPDM rubber. A stress cone 8 in the form of an elongated collar with a dished flange or shed of poorly conducting plastic material surrounds the portion of the tubular member 2 adjacent the support member 3 and distributes the electric field in this region. Stress cones and collars with dished flanges or sheds are widely used for the termination of cables onto overhead lines and busbars, and their design and construction is therefore well known to those skilled in high voltage electrical engineering. Earth collars 9 and 10 conduct leakage currents to earth, and the collar 10 also compresses the end of the stress cone 8 onto the collar portion of the support member 3. The overlapping portions 11 of the collars 6, cap 7, and stress cone 8 are sealed with weatherproof grese (not shown). The stress cone 8 may be dispensed with for voltages of 12 kV and below.

A cover plate 12 is optionally supported by the collar portion of the support member 3, and in such a case a current transformer 15 may be accommodated as shown in the space 13 between the flange of the support member 3 and the plate 12. The gap between the support member 3 and the plate 12 is preferably sealed with a suitable weather-seal (not shown).

The interior part 14 of the tubular member 2 is provided with a ridged surface and may be surrounded by an atmosphere of sulphur hexafluoride within the apparatus casing. Alternatively, the casing may be filled with oil or other suitable insulating fluid.

We claim:

1. A rigid insulating bushing arrangement which passes through, and is stationarily supported by, a casing wall of a high voltage electrical apparatus exposed to weather, said bushing arrangment comprising:

(a) an elongated, rigid electrical conductor extending in an axial direction through a casing wall of a high voltage electrical apparatus;

(b) a rigid tubular insulating member of synthetic resin cast around so as to be bonded in a gas tight manner to the electrical conductor and having an interior portion adapted to be located within the casing wall of the apparatus, and an elongated exterior portion unitary with, and extending axially from, the interior portion beyond the casing wall of the apparatus, said exterior portion having an end face;

(c) a flange around the rigid tubular insulating member in engagement with the casing wall and serving to support the tubular insulating member from the casing wall;

(d) a sheath of weather-resistant insulating material mounted on and enclosing the exterior portion over a major portion of the length of the exterior portion, said sheath including a plurality of axially overlapping and interfitted, individually distinct collars which together extend over the major portion of the length of the exterior portion, said collars being readily detachable from the exterior portion, said sheath further including an insulating cap covering the end face of the exterior portion and detachably mounted on the one of the collars nearest the end face; and (e) a stress cone around the rigid tubular insulating member and axially overlapping and interfitted with the one of the collars nearest the interior portion of the tubular insulating member.

2. The arrangement as recited in claim 1, wherein the insulating material of the sheath is flexible.

3. The arrangement as recited in claim 2, wherein the insulating material of the sheath is composed of EPDM rubber.

4. The arrangement as recited in claim 1, wherein the insulating cap is composed of a resilient flexible material.

5. The arrangement as recited in claim 1, wherein the interior and exterior portions have circular cross-sections, and wherein the interior portion has a predetermined diameter, and wherein the exterior portion has a diameter of a size less than said predetermined diameter.

6. The arrangement as recited in claim 1, and further comprising a current transformer mounted about the tubular insulating member exteriorly of the casing wall.

7. The arrangement as recited in claim 1, wherein the tubular insulating member is composed of a shaped material selected from the group consisting of epoxy resin and polyurethane resin.

8. The arrangement as recited in claim 1, wherein at least one of the collars has a shed of a dished shape.

9. The arrangement as recited in claim 1, and further comprising weather-resistant grease applied over overlapping portions of the interfitted and axially-overlapping collars.

10. The arrangement as recited in claim 1, wherein the stress cone has a shed of a dished shape.

* * * * *

UNITED STATES PATENT AND TRADEMARK OFFICE

CERTIFICATE OF CORRECTION

PATENT NO. : 4,670,625

DATED : June 2, 1987

INVENTOR(S) : Henry S. Wood and John L. Davenport

It is certified that error appears in the above-identified patent and that said Letters Patent are hereby corrected as shown below:

On the Title Page:

[63] Please change "Continuation of Ser. No. 633,970, Jul. 24, 1986, abandoned." to --Continuation of Ser.No. 633,970, Jul. 24, 1984, abandoned.--.

Signed and Sealed this

Nineteenth Day of April, 1988

*Attest:*

DONALD J. QUIGG

*Attesting Officer*

*Commissioner of Patents and Trademarks*